United States Patent [19]

Moritz

[11] 4,041,698

[45] Aug. 16, 1977

[54] EXTERNAL COMBUSTION ENGINE WITH EXHAUST GAS RECIRCULATION OF CONSTANT MASS FLOW RATE

[75] Inventor: Mats Inge Moritz, Trelleborg, Sweden

[73] Assignee: Kommanditbolaget United Stirling (Sweden) AB & Co., Malmo, Sweden

[21] Appl. No.: 583,472

[22] Filed: June 3, 1975

[51] Int. Cl.[2] ..... F02G 1/04

[52] U.S. Cl. ..... 60/39.52; 60/517; 123/119 A; 60/274

[58] Field of Search ..... 60/39.52, 278, 274, 60/516, 517, 524; 123/119 A; 431/115, 89, 90; 137/502

[56] References Cited

U.S. PATENT DOCUMENTS

| | | | |
|---|---|---|---|
| 2,456,213 | 12/1948 | Pell | 123/119 A |
| 2,696,202 | 12/1954 | MacDonald | 123/119 A |
| 3,298,176 | 1/1967 | Forsyth et al. | 60/39.52 |
| 3,780,528 | 12/1973 | Brandenburg | 60/39.27 |
| 3,834,363 | 9/1974 | Goto et al. | 123/119 A |
| 3,846,985 | 11/1974 | Michels et al. | 123/119 A |
| 3,859,794 | 1/1975 | Hakansson | 60/524 |
| 3,918,262 | 11/1975 | Postma | 60/517 |
| 3,935,708 | 2/1976 | Harrewijne et al. | 60/517 |

*Primary Examiner*—Carlton R. Croyle
*Assistant Examiner*—Thomas I. Ross
*Attorney, Agent, or Firm*—Laurence R. Brown

[57] ABSTRACT

To decrease nitrogen oxide formation the exhaust gases of an external combustion engine are recirculated, thus reducing maximum combustion temperature. The static pressure of the combustion air flow is maintained substantially constant and independent of the magnitude of combustion air flow. Fuel is regulated in proportion to the supply of combustion air.

2 Claims, 2 Drawing Figures

Figure 1:
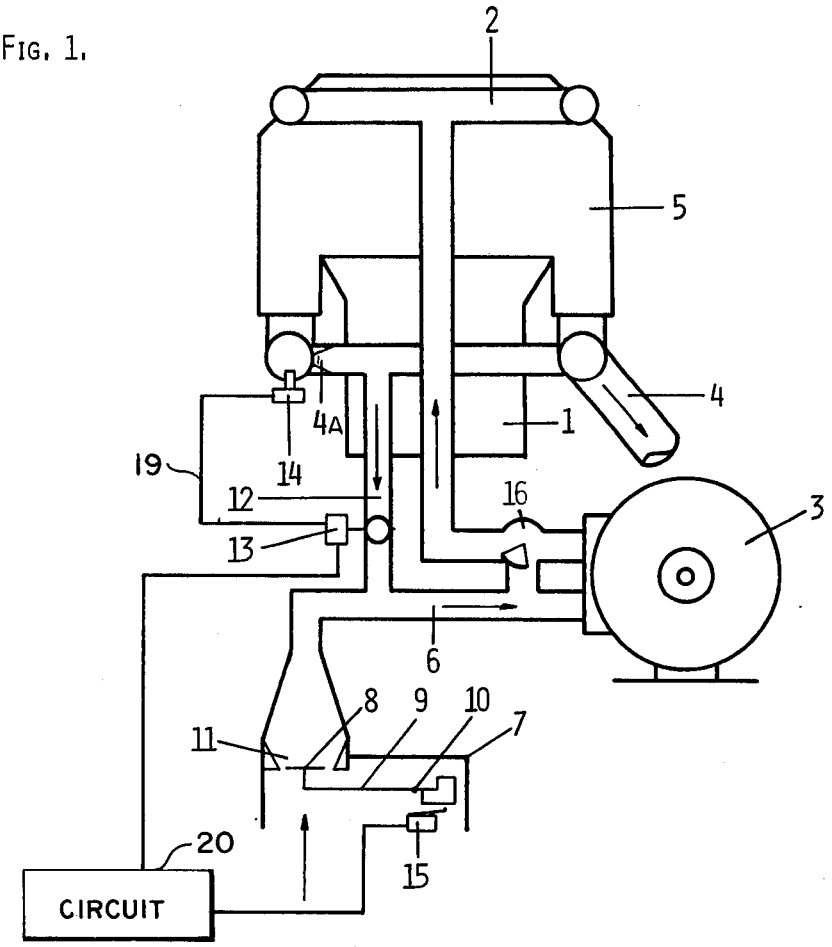

EXTERNAL COMBUSTION ENGINE WITH EXHAUST GAS RECIRCULATION OF CONSTANT MASS FLOW RATE

This invention relates to a method and an arrangement for effecting the method, both the method and the arrangement being of the kind (herein called "the kind defined") in which heat is supplied to an external combustion engine by burning fossil fuel with combustion air in a combustion chamber, and a portion of the gaseous products of combustion (herein called "exhaust gases") is introduced into and mixed with the combustion air before the latter enters the combustion chamber.

Such mixing of exhaust gases and combustion air is called "exhaust gas recirculation."

It is well known to persons skilled in the art that combustion of fossil fuel with air causes formation of nitrogen oxides in the exhaust gases. It is generally desirable to keep the contents of such nitrogen oxides as low as possible. This may be effected by mixing the air for the combustion with a portion of the exhaust gases. Such mixing will lower the maximum temperature obtained during the combustion, and the formation of nitrogen oxides will decrease with decreasing maximum combustion temperature. Such exhaust gas recirculation, however, will increase the losses due to flow friction in the combustion chamber and the gas ducts connected thereto. Thus it will be more difficult to obtain peak power outputs from the engine. Furthermore it is difficult to obtain a most advantageous degree of recirculation at all possible engine power outputs.

The present invention is intended to provide an improved method and arrangement of the kind defined with a view to obtaining a substantially constant amount of recirculated exhaust gases within a wide range of engine power outputs.

According to the invention there is provided a method of the kind defined herein, characterised by the steps of establishing and maintaining a combustion air flow in which the static pressure is substantially constant and independent of the mass flow rate magnitude of this combustion air flow, and introducing the said portion of the exhaust gases into this combustion air flow. Preferably the method includes the steps of establishing and maintaining a substantially constant static pressure in an exhaust gas duct and connecting the exhaust gas duct to the said combustion air flow through a recirculation duct. Advantageously the recirculation duct has a substantially constant predetermined resistance against the flow of exhaust gases.

According to the present invention there is further provided an arrangement of the kind defined comprising a combustion air blower, a combustion air intake duct for said blower, a movable baffle in a divergent part of said intake duct such that the combustion air flow in a further part of said intake duct has a substantially constant static pressure independent of the magnitude of the combustion air flow therein, means for regulating the supply of fuel in proportion to the supply of combustion air, an exhaust gas duct, and a recirculation duct connecting the exhaust gas duct to the said further part of the intake duct.

It is preferred to provide the arrangement with means for establishing and maintaining a substantially constant pressure in said exhaust gas duct, and means for maintaining a substantially constant predetermined resistance against the flow of exhaust gases through the recirculation duct.

Figure 2:
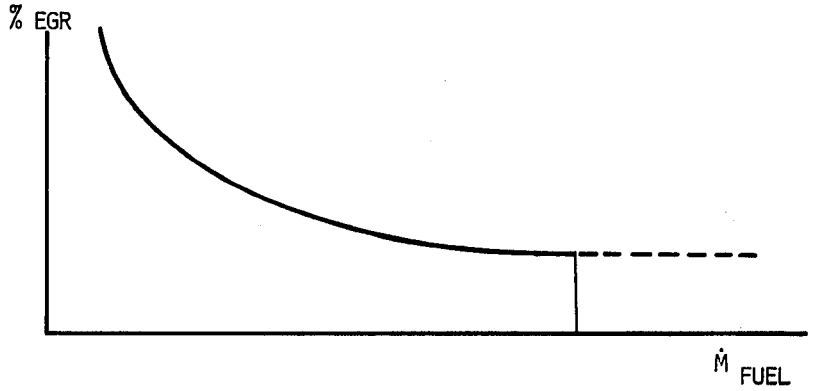

How the invention may be put into practice is described in more detail with reference to the accompanying drawing, in which FIG. 1 schematically shows an arrangement for exhaust gas recirculation according to the invention, and FIG. 2 is a graph showing the percentage of exhaust gases in the combustion air flow as a function of the amount of fuel supplied to an engine provided with an arrangement as shown in FIG. 1.

The arrangement shown in FIG. 1 comprises an external combustion engine 1 supplied with heat by using air for the combustion of a fossil fuel. The air is supplied, via a delivery duct 2 connected to a blower 3, to a combustion chamber (not shown) in the engine 1. Exhaust gases, i.e. gaseous combustion products, leave the combustion chamber via an exhaust duct 4. A heat-exchanger 5 is provided for preheating the combustion air by heat derived from the exhaust gases.

From the atmosphere combustion air passes to the blower 3 via an air intake duct 6 comprising a control device 7 responsive to the flow of air into and through the intake duct 6.

The control device 7 is similar to well known prior art as shown in U.S. Pat. Nos. 3,859,794 and 3,817,229 for example, and comprises a baffle in the form of a disc 8 secured at one end of a lever 9 pivotally mounted at 10. The disc 8 is movable upwardly and downwardly in a conically divergent part 11 of the duct 6. The movements of the lever 9 are transmitted to governing means (not shown) for governing the supply of fuel to the combustion chamber. The said governing means (not shown) are of conventional design and serve for obtaining a predetermined optimum proportion between air and fuel for the combustion at any engine power output.

The device 7 operates such that the static pressure in the part of the air intake duct 6 between the blower 3 and the device 7 is substantially constant.

By similar means 4A known per se the static pressure in the exhaust gas duct 4 is also maintained at a substantially constant (low) value. The duct 4 is connected to the duct 6 by means of a recirculation duct 12 having a predetermined resistance against gas flow, thus automatically ensuring that a substantially constant flow of exhaust gases will be recirculated independent of the total magnitudes of the flows of combustion air and exhaust gases.

In FIG. 2 vertical ordinates relate to percentages of recirculated exhaust gas in relation to supplies of fuel and combustion air to which the horizontal ordinates relate.

As the flow of recirculated exhaust gases is substantially constant the result as shown in FIG. 2 is that in relation to air intake the percentage of recirculated exhaust gases will decrease as the engine power output increases due to increases in the supplies of fuel and combustion air.

During starting of the engine it is desirable to prevent exhaust gas recirculation so that the whole capacity of the blower 3 can be used for supplying fresh combustin air only to the combustion chamber. This is obtained by a flap valve 13 governed by a temperature-responsive device 14 mounted in the exhaust duct 4 as shown by line 19.

Also in order to obtain maximum power output of the engine any recirculation of exhaust gases should be avoided. For this purpose a micro-switch 15 is arranged to be actuated by the lever 9 when there is maximum angular displacement of this lever 9. The micro-switch 15 is mounted in a circuit 20 for actuating the flap-valve 13.

A shunt valve 16 is provided in the delivery duct 2 of the blower 3 solely in order to govern the effective output passing to the duct 2 from the blower 3. If the engine is mounted in an automotive vehicle the periods during which maximum engine power output will occur are usually so short that emissions of nitrogen oxides during such periods may be tolerated.

What is claimed is:

1. A method of decreasing nitrogen oxides in exhaust gases of an external combustion engine having intake, delivery and exhaust gas ducts and a blower coupled between the intake and delivery ducts comprising in combination, the steps of establishing and maintaining a mass combustion air flow in which the static pressure is substantially constant at the intake duct and independent of the mass flow rate magnitude, introducing by a recirculation duct having a substantially constant predetermined resistance against the flow of exhaust gases a portion of the exhaust gases into this combustion air flow at the intake duct and controlling the exhaust gas flow to maintain a substantially constant mass flow rate magnitude of said portion of the exhaust gases over varying mass flow rates of combustion air flow.

2. An external combustion engine comprising a combustin air blower, a combustion air intake duct for said blower, a baffle in said intake duct movably mounted such that the combustion air flow in a further part of said intake duct has a substantially constant static pressure independent of variations in the mass flow magnitude of the combustion air flow therein, means for regulating the supply of fuel in proportion to the supply of combustion air, an exhaust gas duct, a recirculation duct connecting the exhaust gas duct to the said further part of the intake duct, means for establishing and maintaining a substantially constant static pressure in said exhaust gas duct, and means for maintaining a substantially constant predetermined resistance against the flow of exhaust gases through the recirculation duct.

* * * * *